United States Patent [19]

Sweet

[11] Patent Number: 4,832,386

[45] Date of Patent: May 23, 1989

[54] OLD CONSTRUCTION SECURITY HARDWARE

[76] Inventor: Lloyd C. Sweet, 3203B Meridian Way, Palm Beach Gardens, Fla. 33410

[21] Appl. No.: 915,568

[22] Filed: Oct. 6, 1986

[51] Int. Cl.[4] ..... E05C 17/36

[52] U.S. Cl. ..... 292/264; 292/DIG. 53; 292/340

[58] Field of Search ..... 292/264, 340, 346, DIG. 53

[56] References Cited

U.S. PATENT DOCUMENTS

| | | | |
|---|---|---|---|
| 1,867,694 | 7/1932 | Cramer | 292/264 |
| 3,161,429 | 12/1964 | Tornoe et al. | 292/341.18 |
| 3,667,794 | 6/1972 | Lentz, Jr. | 292/264 |
| 3,809,418 | 5/1974 | Canfield | 292/264 |
| 3,944,268 | 3/1976 | Gonzalez et al. | 292/264 |
| 4,027,908 | 6/1977 | Crepinsek | 292/264 |
| 4,057,275 | 11/1977 | La Beaud | 292/340 |
| 4,073,523 | 2/1978 | Long | 292/264 |
| 4,174,862 | 11/1979 | Shane | 292/346 |
| 4,453,751 | 6/1984 | Hamilton | 292/340 |
| 4,474,394 | 10/1984 | Crepinsek | 292/340 |

*Primary Examiner*—Richard E. Moore

*Attorney, Agent, or Firm*—Malin, Haley & McHale

[57] ABSTRACT

A door security hardware system for existing construction that provides a hardware connection between a striker plate that is connected to a wooden door jamb and a chain that is connected to a wall adjacent the wooden door jamb with the chain connected by hardware to the door handle and door catch that is insertable into the striker plate. The system includes a door chain anchor connected to the chain. The system also includes a relatively long interconnecting wall member connected by hardware to and between the striker plate and the door chain anchor and through a substantial portion of an inner portion of the wall.

7 Claims, 2 Drawing Sheets

OLD CONSTRUCTION SECURITY HARDWARE

BACKGROUND OF THE INVENTION

This invention relates to a new and improved door security hardware system for use in existing construction to connect by hardware the striker plate and the chain anchor through the wall. The security hardware system includes a door chain, striker plate, a striker plate bolt receiver and an interconnecting wall system connected between the door chain and the striker plate. The security hardware system passes through a substantial portion of the wall in existing construction. The interconnecting wall system includes an interconnecting wall member connected to the striker plate bolt receiver and an anchor connected to the door chain. The interconnecting wall member and the anchor are connected together in the wall. The hardware system provides a wall portion of a loop connection that is completed through the door bolt, the door knob apparatus, escutcheon plate and the chain.

2. Description of the Prior Art

In the past short screws have been utilized for securing a striker plate to thin door jamb for internal or external door bolt mechanism. Such screws were usually ineffective in preventing forcible entry by destruction of a portion of the door jamb between the striker plate and the edge of the door jamb. Also, many types of chain door fasteners such as surface attached bolt devices have heretofore been utilized for preventing forcible entry into a building or residence dwelling. Most chain door fasteners are also secured to jambs, molding, and trim (or casing) of a door frame by short screws. Short screws are regarded as inadequate for preventing removal of the chain door fastener from the door jamb or molding when an intruder applying force to a door. The inventor's copending application Ser. No. 829,414, filed Feb. 13, 1986, utilizes a security plate on the inside of a new door jamb in new construction to interconnect an external chain to door bolt.

The present invention includes new and improved security hardware system between a striker plate and an external chain that is easily installed in existing construction without removing a door jamb or without installing a new door jamb. The new and improved security hardware system ties the striker plate by hardware passing into a door frame and the wall stud or other adjacent wall structure by use of simple tools.

SUMMARY OF THE INVENTION

This invention relates to a new and novel structure residing in a novel striker plate and bolt receiver, door chain and an interconnecting wall system. The interconnecting wall system includes an interconnecting wall member connected to bolt receiver and a chain anchor connected to the door chain. The interconnecting wall member or means is externally connectable through the striker plate. The anchor is externally connectable through the door frame molding. This novel structure provides the wall portion for a complete loop connection that includes the door bolt, door knob lock apparatus and an escutcheon that is connected to the door knob lock apparatus and the door knob. The door knob escutcheon includes a door chain connector.

The interconnecting wall system includes the striker plate bolt cavity member or portion connected to a striker plate by short screws and a striker plate flange. The interconnecting wall system also includes substantially long security screw or bolt. The long security screw or bolt passes through portion of the wall such as the studs and passes through an opening in the anchor. The long security screw or bolt is attached to and passes through the striker plate bolt cavity member. The screw or bolt passes through the standard milled door jamb and beyond into and through a substantial portion of the wall adjacent the door jamb to incorporate a substantial portion of the wall into the door security hardware system. This new novel and improved existing construction security hardware system can resist most forces applied to a door by an intruder.

This invention provides door hardware that is easily installed on an existing door hardware system and prevents most attempts at forced entry by removal of the chain door fastener from the door frame, as well as forced separation of the striker plate from a door jamb. This improved door hardware system ensures greater security and safety of an occupant in a dwelling.

The chain anchor is installed on the molding or decorative molding by drilling an opening in the molding and through a substantial portion of the adjacent wall. The distal end of the chain anchor is placed deep in the wall with an opening in the anchor in alignment with the longitudinal axis of the wall and is easily connected to the internal end of the interconnecting wall member. A substantially long hole is drilled horizontally into the wall through the opening in the bolt receiver. The interconnecting wall member such as a long security screw or bolt, is placed in the drilled hole through the anchor opening and studs. The long security screw is installed into and through the bottom of a striker plate bolt cavity or receiver member. The long security screw passes through a portion of the adjacent wall, such as through one or more two by four inch studs or blocks. The interconnection with the distal end of the chain anchor completes the wall loop portion that aids in preventing removal of the chain or bolt by a person attempting to gain forced entry through the door.

This invention may also include the other portion of the loop between the bolt and the escutcheon or rose plate in or on the conventional door. The door knob is connected to the escutcheon and is in turn connected to the internal door latching mechanism that is connected to and operates the bolt. The bolt is moveable into and out of a striker plate. This door knob is an escutcheon with the removable key connection means functions to resist great forces applied to the door by a person attempting to separate the escutcheon plate with its key connector means and the chain slide connector from the door. This portion of the loop requires the intruder to separate the whole door knob and latching mechanism from the door in order to open the door without first embolting the bolt or disengaging the chain from the escutcheon. An intruder cannot easily gain unlawful entry through the door. The escutcheon plate is preferably of decorative metal and may be formed of various tough non-metallic materials with a chain slide key connector slot.

OBJECTS OF THE INVENTION

The object of this invention is to improve upon the prior art of door security hardware by the use of an interconnecting wall member for interconnecting the striker plate and striker plate bolt receiver to the door chain anchor for preventing forcible entry into a building, office or dwelling that can be installed easily in existing construction.

Another object of the invention is to provide a new chain door anchor.

Another object is to provide a new and improved striker plate and striker plate bolt receiver.

A further object of the invention is to provide security hardware for securing previously installed doors to prevent forcible entry by an intruder by connecting the security hardware into a rigid portion of the adjacent wall.

An additional object of this invention is to provide a low cost method and low cost security hardware system for preventing forcible entry by an intruder through a previously installed door with a loop portion that connects the striker plate to the chain by an internal wall hardware system or with a loop that includes the loop portion and a door hardware system that connects the bolt to the chain.

The instant invention has been shown and described herein in what is considered to be the most practical and preferred embodiment. It is recognized, however, that departures may be made therefrom within the scope of the invention and that obvious modifications will occur to a person skilled in the art.

DETAILED DESCRIPTION OF THE INVENTION

Figure 1:
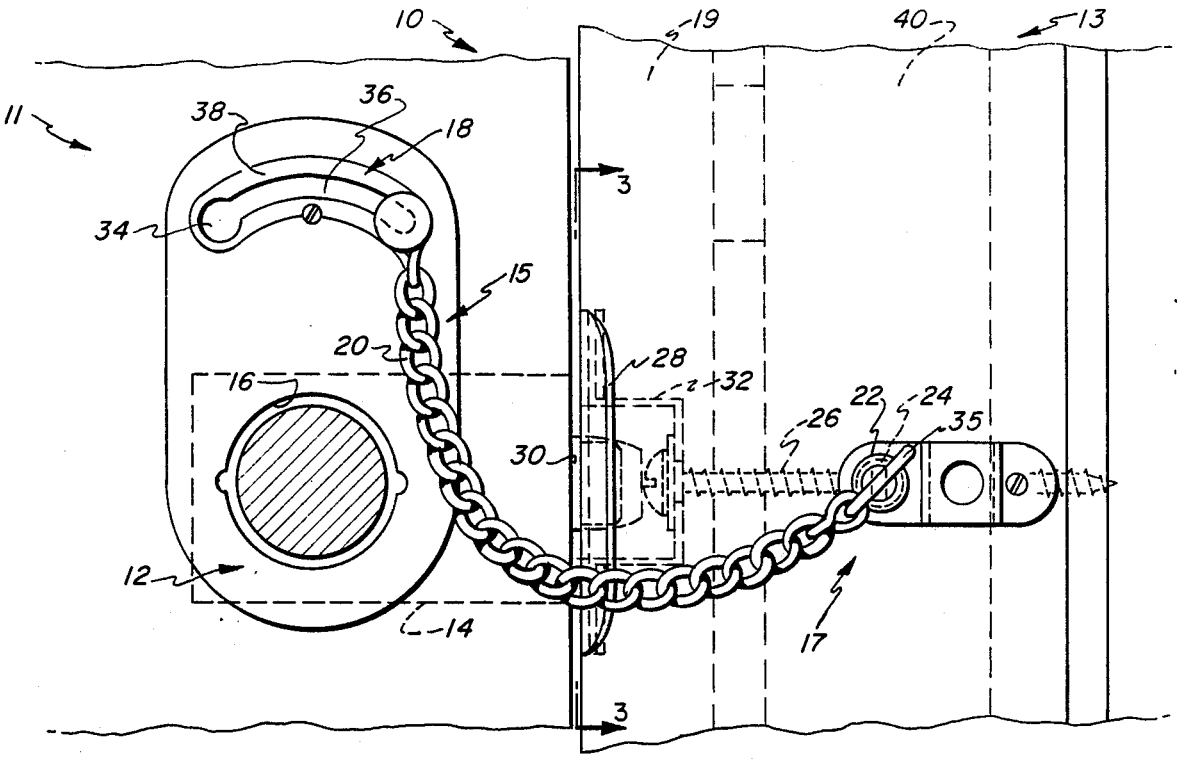
FIG. 1 is a front elevational view of a loop portion of a conventional door and wall with a door bolt system including a novel striker plate and an interconnecting wall member connected through the bottom of a striker plate bolt cavity or receiver member into the chain anchor, and another portion of hardware between the bolt and the chain.
Figure 2:
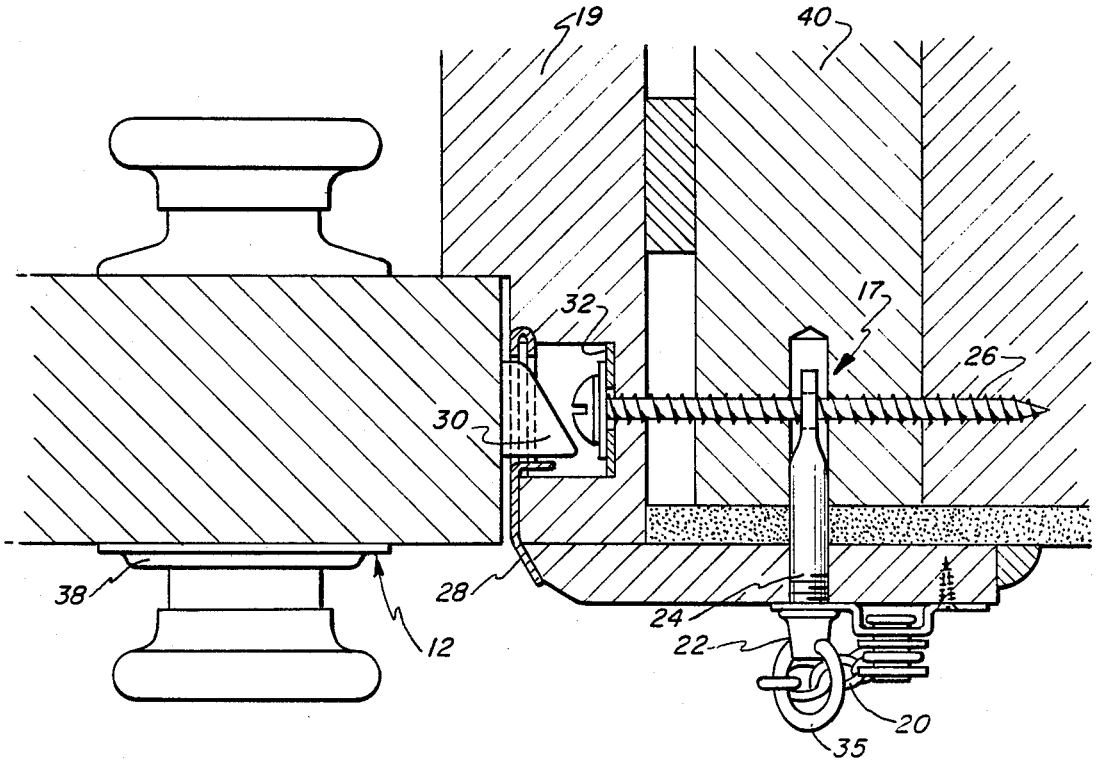
FIG. 2 is a top view of FIG. 1.
Figure 3:
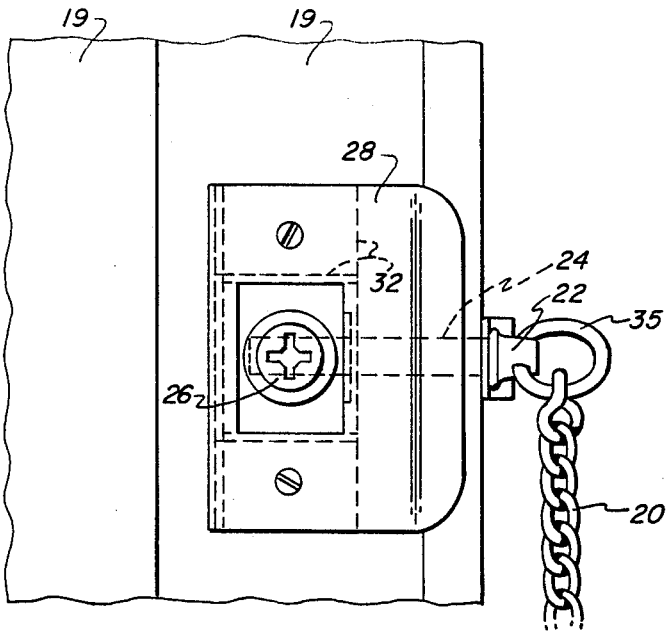
FIG. 3 is a side view taken along line 3—3 in FIG. 1 and looking in the of the arrows.

Referring now to FIGS. 1, 2 and 3, this invention relates to a new and improved door security hardware system 10 for us in existing construction. The security hardware system includes a door 11, a door frame 13, a chain connector assembly 15, striker plate 28, striker plate bolt receiver 32 and a wall interconnecting system between the chain 20 and striker plate latch receiver 32. The interconnecting system passes through a substantial portion of the wall in the existing construction. The interconnecting system includes an interconnecting wall member 26 such as a screw or bolt and a chain anchor 24 that are interconnected. The anchor 24 is connected to the chain 20 and the striker plate bolt receiver 32 is connectable to the door bolt 30. The door bolt 30 is connected to the escutcheon plate 12 through the door knob bolt means 14. The escutcheon 12 is in turn connectable to the chain. The hardware system provides a loop connection through the latch 30 and the chain 20 with a portion of the loop between the striker plate 28 and the chain 20 at the molding 90.

The new and novel structure residing in a new and improved striker plate bolt receiver 32 shown in FIGS. 1, 2 and 3 and chain 20 and the interconnecting system 17. The interconnecting system 17 includes an interconnecting wall member 26 such as a screw or bolt connected to the striker plate bolt receiver 32 with a screw or bolt opening in the bottom and the chain anchor 24 with a through opening in wall end. The security hardware includes an externally connectable interconnecting wall member 26 or means constructed and arranged to provide a structural hardware interconnection with the striker plate 28 shown in FIGS. 4 and 7. The door bolt or latch 30 is connectable into the opening 93 of the striker plate 28. The door bolt is connected by hardware to the door knob bolt means or apparatus 14 and by hardware to the escutcheon 12. The door knob bolt apparatus 14 is connected by hardware to the door knob 16. The escutcheon 12 is connectable to the chain. A chain anchor 24 shown going inwardly into the wall adjacent the door 11. The chain 20 is connected to a swivel 22 on the outer end of the anchor 24. The other end of the chain 20 is connectable to the door knob escutcheon 12.

Figure 6:
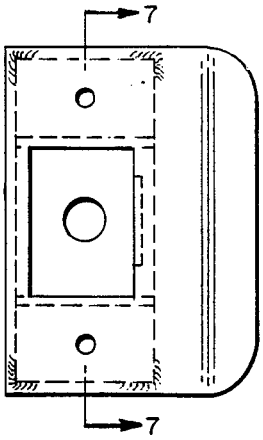
FIG. 6 is a one piece striker plate and latch receiver.
Figure 7:
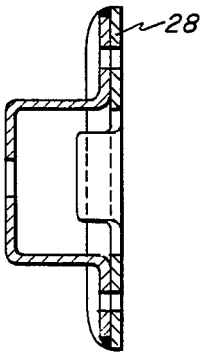
FIG. 7 is a cross section side view of FIG. 6 taken through lines 7—7 in the direction of the arrows.
Figure 8:
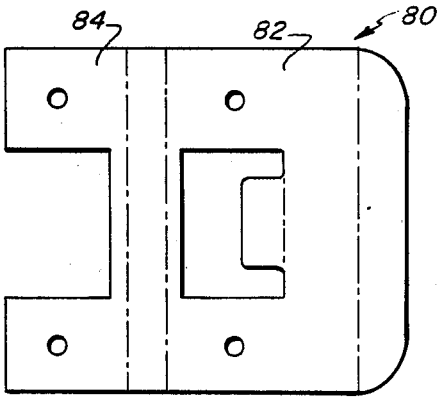
FIG. 8 is a top view of the striker plate before it is bending as shown in FIG. 9.
Figure 5:
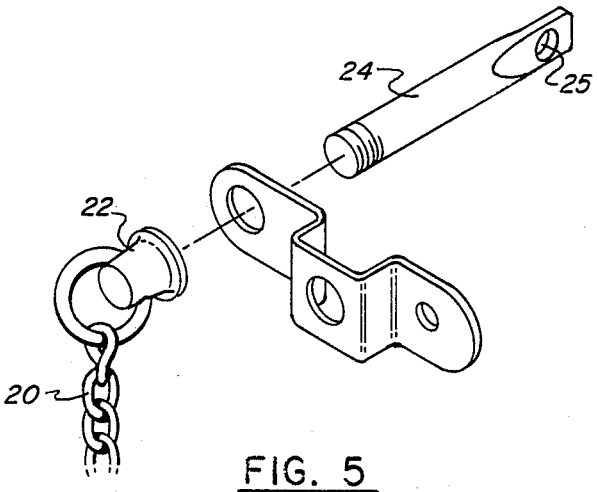
FIG. 5 is a side view of the anchor.
Figure 9:
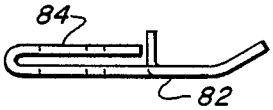
FIG. 9 is a side view of the striker plate in FIG. 8 after it is bent.

The interconnecting system 15 striker plate bolt member or portion may be made in one or two pieces. The two part striker plate shown in FIG. 4 includes the striker plate shown in FIGS. 8 and 9. The one piece striker plate 28' is shown in FIGS. 6 and 7.

The striker plate 30 is connected to the striker plate bolt receiver 32 by short screw s in openings 87 and a substantially long security screw or bolt 26. The long security screw 26 passes through the inner end opening 97 of the anchor 24. The long security screw 26 is attached to the striker plate bolt member and through an opening in the standard milled door jamb 19 and beyond into and through a portion of the wall at 40 adjacent the door jamb 19 and through an opening 25 in the new and novel chain anchor 24 as shown in FIGS. 1, 2 and 3. This construction security hardware closes the loop of hardware that includes the door latch 30 and chain 20. This system resists relatively great forces that are applied to a door 11 by an intruder by connecting the striker plate at the jamb side into the wall studs or a comparable wall portion and bolt at the door side to the latching mechanism, door knob and escutcheon. The door hardware is easily installed on an existing door and door frame by use of a drill. The improved door hardware ensures greater security and safety of an occupant of existing dwellings.

As to the door side of the escutcheon plate 12 is in the form of a rose or escutcheon connected directly to a conventional door knob 16 so that the door knob and escutcheon become one member. The entire internal door latching mechanism 14 as illustrated, is connected directly to the latch 30 and directly to the door knob and escutcheon. The bolt or latch is moveable into and out of a striker plate bolt receiver 32. This entire door hardware from the bolt 30 to the escutcheon 12 functions as a unit to resist forces applied to the door and prevents separation of the escutcheon plate alone from the door. The door knob shaft operates the door latch 30 through mechanism 14. Escutcheon 12 is maintained in contact with the surface of the door by the outside and inside knobs. The escutcheon 12 is connected to the chain 20 by a chain slide key connector slot 18. The chain includes a key 19 at the door end that is shaped like a roman numeral one, see FIG. 3. The escutcheon plate is preferably of decorative metal and may be formed of various non-metallic material with a chain slide key 19, connector slot 18 with locking slot 36 with raised sides 38 and release and entrance opening 34. The space below raised portion 38 on both sides of 36 is filled by enlarged edges of key 19 after they are placed in opening 34 and moved to the right to the position shown.

On the wall side a hole is drilled into the molding 90 through the longitudinal center line of the screw 26. The chain anchor 24 is placed in the hole into the wall. The distal end of the chain anchor 24 with opening 26 is placed in the wall 13 and is for easy connection with the inner end of the interconnecting wall member 26. The long security screw 26 may be of hard steel and is installed into and through a hole in the wall starting at the hole in the bottom of the striker plate recess member or portion 32 The long security screw 26 passes through a portion of the adjacent wall, such as through one or two studs, such as two by four inch stud 40. The screw 26 passes into or through the distal inner end of the chain anchor 24 to aid in preventing removal by forced entry of the chain from the wall connection point.

Figure 4:
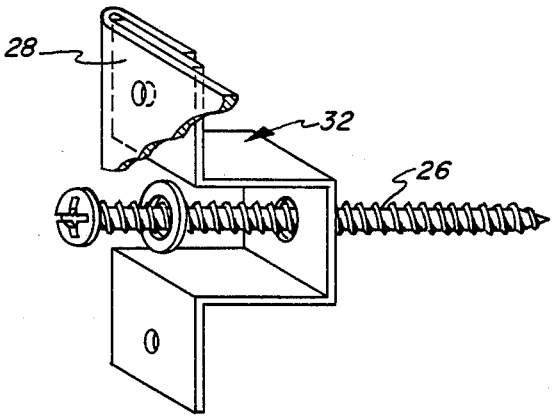
FIG. 4 an of a portion of the striker plate and the striker plate latch receiver, the interconnecting wall member and anchor.

It should be noted that the door latch 30 moves over and into striker plate 28 filling the striker plate opening and into the cavity in the jamb 19 below the striker plate. The latch is surrounded by striker plate lock recess member 32 and the lip 98 of the striker plate 28. The striker plate 28 is placed above the striker plate lock recess member 32. The striker plate C-shaped portions 84 are placed below the wings on the member 32 as shown in FIG. 4. The chain is maintained in functional secured relationship to the upper end of chain anchor 24 by having swivel connecting means on the side opposite opening 25 for receiving chain 20. The chain may be screwed or welded to the swivel connected to the anchor. Opening 97 in lower end allows the interconnecting wall member to pass through to secure the chain and anchor to the wall stud.

The interconnecting wall member 26 is made of rigid metal or similar material. The interconnecting wall member 26 includes a head 62 and long shaft 64. The head 62 is positioned on the outer surface of member 32 and the shaft 64 is driven through filler studs and at least into a substantial portion of the wall. The shaft 64 passes through the opening 97 in member 32 and the opening 25 in anchor 24 to secure the chain and bolt to a wall stud. Door jamb 19 includes an opening for receiving bent portions of member 32. The bolt or screw 24 engages the outside surface of the member 32 or portion. Portion 82 of the striker plate is secured to the face of the jamb by screws or the like through openings 99 in the portion 82 and the striker plate.

The escutcheon plate 12 and member 32 and screw 26 are integrally connected by the bolt or latch 30 when the door is closed and by the chain 20 when the chain is in slot 36.

By the above construction of functionally integrating both the escutcheon plate and the wall studs, forcible entry by an intruder is made more difficult since an intruder to gain unlawful entry into a building utilizing the herein described total loop invention must sheer (1) the escutcheon plate, door knobs, lock mechanism from the door or (2) the member 32 and screw 26 and anchor 24 and stud 40 from the wall. This cannot be easily accomplished by one utilizing the present invention.

It is evident from the above disclosures that other modifications are within the scope thereof without departing from the spirit of the invention or sacrificing the principle advantages thereof.

What is claimed is:

1. Door security hardware for existing construction including hardware connection between a striker plate connected to a door jamb and a chain connected to a wall adjacent the door jamb comprising:

said striker plate including an underside positionable against the door jamb;

a door chain anchor connected to said chain;

said door chain anchor having an inner end connectable into the door jamb;

a relatively long interconnecting in wall hardware means connected between said striker plate and said inner end of said anchor, through a substantial portion of an inner portion of said wall;

said interconnecting wall means being substantially long for interconnecting said substantial portion of said inner portion.

2. Door security hardware for existing construction as set forth in claim 1, including a bolt recess means securely connected by hardware to and between said striker plate and said interconnecting wall means.

3. A door hardware lock system directly connected through hardware a door and an existing construction door jamb by a bolt means connected to the door and a chain lock connected outside the door and existing construction door jamb in a loop configuration to secure the door with said bolt means to the adjacent door jamb, comprising:

a relatively long interconnecting wall means connected through a substantial portion of a wall adjacent said bolt means;

a striker plate means with a door bolt opening connected to said door jamb and directly connected to said interconnecting wall means;

said bolt means for movement directly into and out of said striker plate, said bolt means connected in said door;

said bolt means connected to a control means;

an escutcheon directly connected by said control means to said latch means;

said escutcheon including a chain connecting means;

a chain including a connecting means at one end connected to said interconnecting wall and a releasable connecting means at the other end for connecting and unconnecting said chain to said chain connecting means in said escutcheon;

said chain connected to a distal end of said interconnecting wall means for positioning substantially within said wall.

4. A door hardware lock system as set forth in claim 3, wherein, said interconnecting wall means passes through at least one wall stud;

an anchor connected between one of the chain connecting means and said distal end of said interconnecting wall means, said anchor has an opening adjacent its distal end for mating with said interconnecting wall means.

5. A door hardware lock system as set forth in claim 4, wherein:

said striker plate means including:

a striker plate;

a bolt recess means of approximately the same strength as said striker plate;

said recess means connected to an underside of said striker plate;

said recess means having a lower portion and a connecting portion;

a perimeter means about an opening in said lower portion of said recess means, said perimeter means for receiving said interconnecting wall means to be connected to said chain.

6. A door hardware lock system as set forth in claim 5, wherein:

said striker plate and recess means are separate members, said recess means including wing portions; said striker plate including C-shaped portion means for receiving and connecting said wing portions to said striker plate.

7. Door security hardware comprising:

a striker plate means including:

a striker plate:

a bolt recess means of approximately the same strength as said striker plate;

said bolt recess means connected to an underside of said striker plate;

said recess means having a lower portion and a connecting portion;

a perimeter means about an opening in said lower portion of said recess means, said perimeter means for receiving a chain lock hardware connector;

said striker plate and recess means are separate members, said recess means including wing portions;

said striker plate including C-shaped portion means for receiving and connecting said wing portions to said striker plate.

* * * * *